US011535973B2

(12) United States Patent
Cinello et al.

(10) Patent No.: US 11,535,973 B2
(45) Date of Patent: Dec. 27, 2022

(54) LAUNDRY TREATMENT APPLIANCE COMPRISING AN IMPROVED DRAWER

(71) Applicant: Electrolux Appliances Aktiebolag, Stockholm (SE)

(72) Inventors: Mauro Cinello, Porcia (IT); Daniele Da Riol, Porcia (IT); Carlo Gardin, Porcia (IT)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 17/266,714

(22) PCT Filed: Aug. 23, 2019

(86) PCT No.: PCT/EP2019/072627
§ 371 (c)(1),
(2) Date: Feb. 8, 2021

(87) PCT Pub. No.: WO2020/043630
PCT Pub. Date: Mar. 5, 2020

(65) Prior Publication Data

US 2021/0301454 A1 Sep. 30, 2021

(30) Foreign Application Priority Data

Aug. 30, 2018 (EP) ..... 18191669

(51) Int. Cl.
*D06F 39/02* (2006.01)

(52) U.S. Cl.
CPC ..... *D06F 39/02* (2013.01); *D06F 39/022* (2013.01); *D06F 39/028* (2013.01)

(58) Field of Classification Search
None
See application file for complete search history.

(56) References Cited

U.S. PATENT DOCUMENTS 2,893,230 A 7/1959 Gibson
2,942,446 A 6/1960 Platt et al.
(Continued)

FOREIGN PATENT DOCUMENTS

CN 103757861 A 4/2014
CN 105937145 A 9/2016
(Continued)

OTHER PUBLICATIONS

International Search Report and Written Opinion for International Application No. PCT/EP2019/072627, dated Nov. 4, 2019, 9 pages.
(Continued)

*Primary Examiner* — Cristi J Tate-Sims
(74) *Attorney, Agent, or Firm* — RatnerPrestia

(57) ABSTRACT

A laundry treatment appliance having a drawer adapted to slide within a drawer seat along a sliding direction. The drawer has: a handle forming the drawer front; at least one compartment adapted to contain multiple doses of at least one treatment agent; at least one channel associated with the at least one compartment for channeling water and at least one treatment agent dose of the at least one laundry treatment agent towards a mixing region of the drawer seat allowing a mixture between the water and the at least one treatment agent dose; and at least one pump actuation part having a suction side in fluid communication with the at least one compartment for drawing up the at least one treatment agent dose therefrom, and a delivery side in fluid communication with the at least one channel for delivering the at least one treatment agent dose thereto.

13 Claims, 10 Drawing Sheets

(56) References Cited

U.S. PATENT DOCUMENTS

| | | | |
|---|---|---|---|
| 4,900,177 | A | 2/1990 | Ferguson |
| 5,356,207 | A | 10/1994 | Röck et al. |
| 5,741,125 | A | 4/1998 | Neftel et al. |
| 7,578,150 | B2 | 8/2009 | Zsambeki |
| 8,037,720 | B2 | 10/2011 | Hellhake et al. |
| 8,220,293 | B2 | 7/2012 | Deppermann et al. |
| 8,448,480 | B2 | 5/2013 | Hasse et al. |
| 8,448,769 | B2 | 5/2013 | Knowles |
| 8,813,526 | B2 | 8/2014 | Doyle et al. |
| 9,057,150 | B2 | 6/2015 | Zattin et al. |
| 9,309,617 | B2 | 4/2016 | Buso et al. |
| 9,334,602 | B2 | 5/2016 | Hasse et al. |
| 9,481,959 | B2 | 11/2016 | Doyle et al. |
| 9,506,183 | B2 | 11/2016 | Del Pos et al. |
| 9,644,307 | B2 | 5/2017 | Da Pont et al. |
| 9,816,218 | B2 | 11/2017 | Jo et al. |
| 9,816,219 | B2 | 11/2017 | Jo et al. |
| 9,834,879 | B2 | 12/2017 | Song et al. |
| 9,879,370 | B2 | 1/2018 | Jung et al. |
| 10,077,527 | B2 | 9/2018 | Back et al. |
| 10,125,448 | B2 | 11/2018 | Seo et al. |
| 10,132,023 | B2 | 11/2018 | Doyle et al. |
| 10,138,587 | B2 | 11/2018 | Doyle et al. |
| 10,378,140 | B2 | 8/2019 | Del Pos et al. |
| 10,400,380 | B2 | 9/2019 | Lee |
| 10,415,173 | B2 | 9/2019 | Seo et al. |
| 10,513,818 | B2 | 12/2019 | Favaro et al. |
| 10,519,588 | B2 | 12/2019 | Doyle et al. |
| 10,640,908 | B2 | 5/2020 | Favaro et al. |
| 11,203,830 | B2 | 12/2021 | Wang et al. |
| 2005/0274155 | A1 | 12/2005 | Namkung et al. |
| 2009/0320313 | A1 | 12/2009 | Bae et al. |
| 2010/0000581 | A1 | 1/2010 | Doyle et al. |
| 2010/0275659 | A1 | 11/2010 | Son et al. |
| 2012/0096901 | A1* | 4/2012 | Zattin ..... D06F 39/022 68/13 R |
| 2012/0159997 | A1 | 6/2012 | Del Pos et al. |
| 2013/0312463 | A1 | 11/2013 | Kim et al. |
| 2016/0138207 | A1 | 5/2016 | Del Pos et al. |
| 2016/0258106 | A1 | 9/2016 | Kim |
| 2016/0273150 | A1 | 9/2016 | Del Pos et al. |
| 2017/0233934 | A1 | 8/2017 | Lee |
| 2017/0356119 | A1 | 12/2017 | Favaro et al. |
| 2019/0345661 | A1 | 11/2019 | Ko et al. |
| 2019/0368110 | A1 | 12/2019 | Wang et al. |
| 2020/0232147 | A1 | 7/2020 | Jung et al. |
| 2020/0309041 | A1 | 10/2020 | Rosquist |
| 2020/0392662 | A1 | 12/2020 | Lv et al. |
| 2021/0062392 | A1 | 3/2021 | Jung et al. |
| 2021/0062395 | A1 | 3/2021 | Jung et al. |
| 2021/0062396 | A1 | 3/2021 | Jung et al. |

FOREIGN PATENT DOCUMENTS

| | | | |
|---|---|---|---|
| DE | 3246127 | A1 | 6/1984 |
| DE | 8403009 | U1 | 7/1995 |
| EP | 0528768 | B1 | 2/1993 |
| EP | 1842953 | A2 | 10/2007 |
| EP | 2048276 | B1 | 9/2010 |
| EP | 2251481 | A1 | 11/2010 |
| EP | 2492387 | A1 | 8/2012 |
| EP | 2642014 | A1 | 9/2013 |
| EP | 3192916 | B1 | 7/2017 |
| EP | 3617381 | A1 | 3/2020 |
| FR | 2193106 | A1 | 2/1974 |
| GB | 1402878 | | 8/1975 |
| KR | 101637464 | B1 | 7/2016 |
| WO | 2008010671 | A2 | 1/2008 |
| WO | 2015022622 | A1 | 2/2015 |
| WO | 2015074688 | A1 | 5/2015 |

OTHER PUBLICATIONS

Chinese Office Action for Chinese Application No. 201980055704.X, dated Jul. 20, 2022, with translation, 19 pages.

* cited by examiner

LAUNDRY TREATMENT APPLIANCE COMPRISING AN IMPROVED DRAWER

This application is a U.S. National Phase application of PCT International Application No. PCT/EP2019/072627, filed Aug. 23, 2019, which claims the benefit of European Application No. 18191669.3, filed Aug. 30, 2018, both of which are incorporated by reference herein.

FIELD OF THE INVENTION

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing appliances and laundry washing appliances also implementing laundry drying functions (also referred to as washers/dryers). More particularly, the present invention relates to a laundry appliance having an improved drawer.

BACKGROUND OF THE INVENTION

A laundry appliance typically comprises a drawer having drawer compartments for containing one or more treatment agents (such as liquid and powder treatment agents), and a drawer seat for slidably housing the drawer within it between retracted and extracted positions.

In an increasingly common type of laundry appliance, the drawer comprises one or more compartments each one adapted to contain multiple doses of a respective treatment agent for performing multiple washing cycles (hereinafter referred to as multi-dose compartments): just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each washing cycle (and when the auto-dosing functionality is enabled), a predetermined amount of treatment agent is automatically taken (e.g., by means of a pumping apparatus) from the multi-dose compartment(s) and dispensed to a washing tub.

The pumping apparatus is generally controlled by an electronic control unit, which is arranged in the laundry appliance and is configured to be electrically connected to the pumping apparatus so as to cause the treatment agent(s) to be dispensed according to predetermined operating modes.

The pumping apparatus is typically mounted on the drawer associated with the multi-dose compartments, and is electrically connected to the electronic control unit by means of a mechanical connection (which is interrupted every time the drawer is moved from the retracted position to the extracted position): this mechanical connection typically comprises one or more connection members mounted on the drawer and one more connection members mounted on the drawer seat, the connection member(s) mounted on the drawer and the connection member(s) mounted on the drawer seat being configured to engage and disengage with each other every time the drawer is moved to the retracted position and removed from the retracted position, respectively.

SUMMARY OF INVENTION

The Applicant has realized that the typical laundry appliances implementing the auto-dosing functionality are not satisfactory.

The Applicant has understood that having the pumping apparatus on the drawer causes a remarkable reduction of the treatment agent loading capacity of the multi-dose compartments: in fact, for reasons due to electric safety, DC and low-power electric motors should be used in association with the pumping apparatus, which necessarily require power supply units (e.g., AC-to-DC power supply units); this involves complex and bulky implementations.

The Applicant has also understood that having the pumping apparatus on the drawer (and in some cases operatively immersed in the respective treatment agents) makes electric wirings expensive: in fact, also the electric wirings need complex and expensive solutions required in order to make these electric wirings reliable for a wet environment for a relatively long periods of use.

The Applicant has further understood that frequent moving of the drawer between the extracted and retracted positions involves a considerable risk that, in time, the mechanical connection (i.e., the connection member(s) mounted on the drawer and the connection member(s) mounted on the drawer seat) is affected by wear, which causes the electric connection between the pumping apparatus and the electronic control unit to be unreliable. This may cause serious faults and failures of the laundry appliance.

In view of the above, it is an object of the present invention to provide a laundry appliance able to overcome these, as well as other, drawbacks, and particularly it is an object of the present invention to provide a laundry appliance featuring an improved drawer and an efficient and reliable cooperation between the drawer and the drawer seat.

One or more aspects of the present invention are set out in the independent claims, with advantageous features of the same invention that are indicated in the dependent claims. An aspect of the present invention relates to a laundry treatment appliance comprising a drawer adapted to slide within a drawer seat along a sliding direction. The drawer comprises, along the sliding direction from a drawer front:

- a handle forming the drawer front;
- behind the handle, at least one compartment adapted to contain multiple doses of at least one treatment agent;
- behind the at least one compartment, at least one channel associated with the at least one compartment for channeling water and at least one treatment agent dose of the at least one laundry treatment agent towards a mixing region of the drawer seat allowing a mixture between the water and the at least one treatment agent dose;
- behind the at least one channel, at least one pump actuation part having a suction side in fluid communication with the at least one compartment for drawing up the at least one treatment agent dose therefrom, and a delivery side in fluid communication with the at least one channel for delivering the at least one treatment agent dose thereto.

According to an embodiment of the present invention, the drawer is adapted to slide within the drawer seat between an extracted position and a retracted position. The drawer seat preferably comprises at least one electrically-operated pump driving part that, in the retracted position of the drawer, is adapted to mechanically couple with the at least one pump actuation part for allowing driving the pump actuation part.

According to an embodiment of the present invention, the at least one channel allows the water and the at least one treatment agent dose to fall towards the mixing region of the drawer seat by gravity.

According to an embodiment of the present invention, the sliding direction is parallel to a rest surface on which the laundry treatment appliance rests in operation. The at least one channel preferably extends vertically or (substantially vertically) with respect to said rest surface.

According to an embodiment of the present invention, the at least one channel comprises a top channel input for receiving the water and a bottom channel output. In operation the bottom channel output of the at least one channel preferably faces said mixing region of the drawer seat for delivering the water and at least one treatment agent dose thereto.

According to an embodiment of the present invention, said mixing region of the drawer seat comprises a bottom wall of the drawer seat.

According to an embodiment of the present invention, the bottom wall of the drawer seat is slanted or inclined in order to promote a flow of said mixture between the water and the at least one treatment agent dose towards a laundry treatment chamber of the laundry treatment appliance.

According to an embodiment of the present invention, the laundry treatment appliance further comprises at least one suction pipe coupling the suction side of the at least one pump actuation part to an interior of the at least one compartment for drawing up the at least one treatment agent dose therefrom, and at least one delivery pipe coupling the delivery side of the at least one pump actuation part to an interior of the at least one channel for delivering the at least one treatment agent dose thereto.

According to an embodiment of the present invention, the at least one suction pipe is arranged, in said interior of the at least one compartment, proximate to a bottom wall of the at least one compartment.

According to an embodiment of the present invention, the at least one delivery pipe opens to said interior of the at least one channel.

According to an embodiment of the present invention, the laundry treatment appliance further comprises a water distribution system having at least one water feeding duct adapted to feed water to the at least one channel; the at least one water feeding duct is preferably part of a top of the drawer seat thereby allowing the water to be fed to the at least one channel from above.

According to an embodiment of the present invention, the at least one water feeding duct comprises a single water feeding duct associated with the at least one channel or a plurality of water feeding ducts each one associated with a respective one of the at least one channel.

According to an embodiment of the present invention, the water distribution system comprises first and second input water ducts each one selectable for water passage therethrough. The water distribution system preferably comprises first, second and third output water ducts each one selectable for water passage therethrough according to the first and/or second input water ducts being selected. The at least one water feeding duct preferably comprises one or more among the first, second and third output water ducts.

According to an embodiment of the present invention, said at least one compartment comprises two compartments arranged side by side; each one of said two compartments is preferably adapted to contain multiple doses of a respective laundry treatment agent.

According to an embodiment of the present invention, said at least one channel comprises two channels each one associated with a respective one of said two compartments.

According to an embodiment of the present invention, the at least one water feeding duct comprises a single water feeding duct associated with both said two channels.

According to an embodiment of the present invention, the laundry treatment appliance further comprises at least one further compartment each one adapted to contain a single dose of said at least one treatment agent. At least one among the first, second and third output water ducts is preferably adapted to feed water to the at least one further compartment.

According to an embodiment of the present invention, said at least one further compartment is, along the sliding direction, between the handle and the at least one compartment.

Another aspect of the present invention relates to a drawer for a laundry treatment appliance. The drawer is adapted to slide, along a sliding direction, within a drawer seat of the laundry treatment appliance. The drawer preferably comprises, along the sliding direction from a drawer front:

- a handle forming the drawer front;
- behind the handle, at least one compartment adapted to contain multiple doses of at least one treatment agent;
- behind the at least one compartment, at least one channel associated with the at least one compartment for channeling water and at least one treatment agent dose of the at least one laundry treatment agent towards a mixing region of the drawer seat allowing a mixture between the water and the at least one treatment agent dose;
- behind the at least one channel, at least one pump actuation part having a suction side in fluid communication with the at least one compartment for drawing up the at least one treatment agent dose therefrom, and a delivery side in fluid communication with the at least one channel for delivering the at least one treatment agent dose thereto.

According to an embodiment of the present invention, the drawer is adapted to slide within the drawer seat between an extracted position and a retracted position. In the retracted position of the drawer the at least one pump actuation part of the drawer is preferably adapted to mechanically couple with at least one electrically-operated pump driving part provided on the drawer seat for allowing driving of the pump actuation part.

According to an embodiment of the present invention, the at least one channel allows the water and the at least one treatment agent dose to fall towards the mixing region of the drawer seat by gravity.

According to an embodiment of the present invention, the sliding direction is parallel to a rest surface on which the laundry treatment appliance rests in operation. The at least one channel preferably extends vertically or (substantially vertically) with respect to said rest surface.

According to an embodiment of the present invention, the at least one channel comprises a top channel input for receiving the water and a bottom channel output. In operation the bottom channel output of the at least one channel preferably faces said mixing region of the drawer seat for delivering the water and at least one treatment agent dose thereto.

According to an embodiment of the present invention, the drawer further comprises at least one suction pipe coupling the suction side of the at least one pump actuation part to an interior of the at least one compartment for drawing up the at least one treatment agent dose therefrom, and at least one delivery pipe coupling the delivery side of the at least one pump actuation part to an interior of the at least one channel for delivering the at least one treatment agent dose thereto.

According to an embodiment of the present invention, the at least one suction pipe is arranged, in said interior of the at least one compartment, proximate to a bottom wall of the at least one compartment.

According to an embodiment of the present invention, the at least one delivery pipe opens to said interior of the at least one channel.

According to an embodiment of the present invention, said at least one compartment comprises two compartments arranged side by side; each one of said two compartments is preferably adapted to contain multiple doses of a respective laundry treatment agent.

According to an embodiment of the present invention, said at least one channel comprises two channels each one associated with a respective one of said two compartments.

According to an embodiment of the present invention, the drawer further comprises at least one further compartment each one adapted to contain a single dose of said at least one treatment agent.

According to an embodiment of the present invention, said at least one further compartment is, along the sliding direction, between the handle and the at least one compartment.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
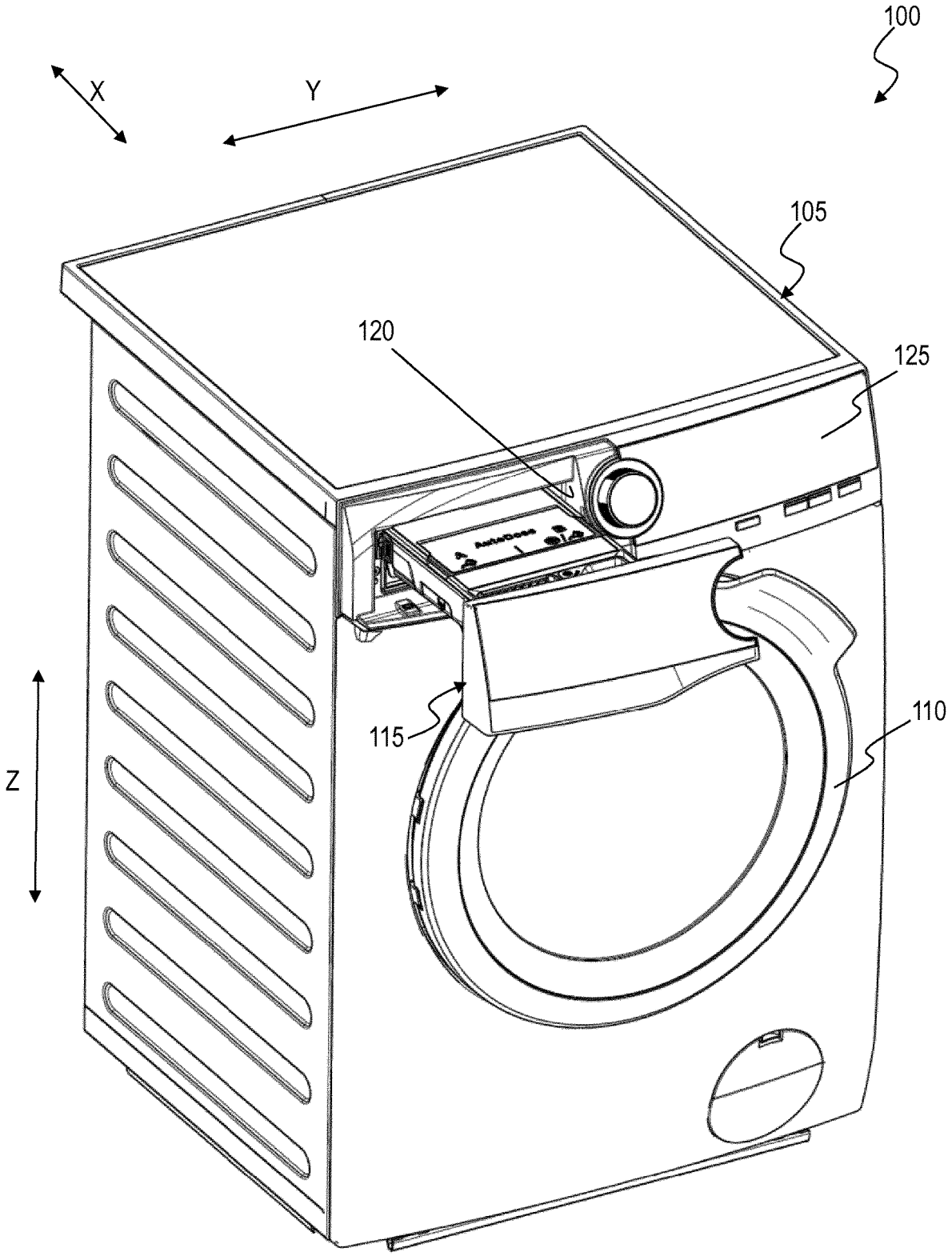
FIGS. 1A and 1B show perspective views of a laundry appliance according to an embodiment of the present invention.
Figure 1B:
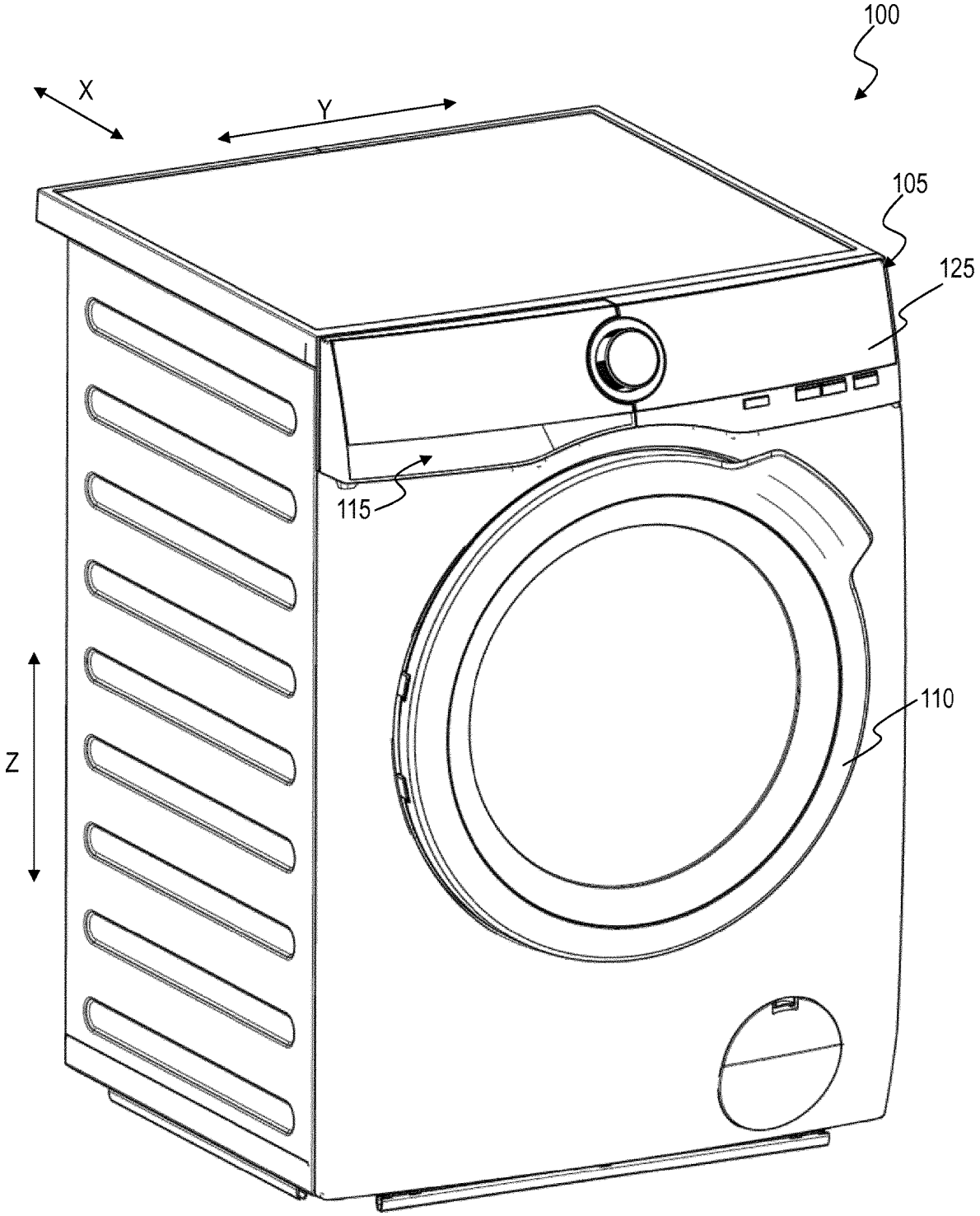

With reference to the drawings, FIGS. 1A and 1B show perspective views of a laundry appliance 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions).

The laundry appliance 100 comprises a (e.g., parallepiped-shaped) cabinet 105, which preferably accommodates a treatment chamber (i.e., a laundry washing chamber in the example herein considered of a washing machine) for performing a laundry treatment cycle on items housed therein (i.e., a washing cycle on a laundry load in the example herein considered of a washing machine).

The treatment chamber preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pumps and impellers of the hydraulic apparatus, one or more heating elements for heating water/treatment agents/air).

The laundry appliance 100 further comprises a drawer 115 for containing one or more laundry treatment agents (or, concisely, treatment agents), such as liquid and powder treatment agents including, but not limited to, washing detergents, rinsing detergents, bleaches and softeners.

The laundry appliance 100 also comprises a drawer seat 120 (preferably provided on a top part of a cabinet front) for housing the drawer 115, the drawer being advantageously adapted to slide within the drawer seat 120, along a longitudinal or sliding direction X, between an extracted position (shown in FIG. 1A) and a retracted position (shown in FIG. 1B). The sliding direction X is for example parallel to a rest surface, such as the floor, on which the laundry appliance 100 preferably rests in operation (i.e., when it is installed in the user premises). In operation, the laundry appliance 100 rests on the rest surface, such as the floor, and uprightly extends from it along a vertical direction Z orthogonal to the sliding direction X.

Preferably, the laundry appliance 100 further comprises a user interface 125, the user interface 125 being preferably provided on the top part of the cabinet front, more preferably next to the drawer seat 120 along a transversal direction Y orthogonal to the longitudinal direction X.

Preferably, although not necessarily, the user interface 125 comprises a display unit, not shown, for visually displaying one or more pieces of information; the display unit may for example be a light emitting polymer display (LPD), a liquid crystal display, a thin film transistor-liquid crystal display, or an organic light-emitting diode display.

The user interface 125 preferably comprises one or more control elements (e.g., selection buttons and/or knobs) for allowing the user to select a washing cycle and to control one or more operating parameters of the selected washing cycle (including, but not limited to, temperature, laundry load dirt level, spin speed, start time delay, drawer compartment selection, treatment agent selection). Additionally, as herein exemplary assumed, or alternatively, the user interface 125 preferably comprises one or more status indicators for indicating to the user a status of the laundry appliance 100; the status indicators may be configured to indicate a status of one or more components of the laundry appliances 100 and/or a status of the washing cycle (including, but not limited to, information about a residual time to the end of the ongoing washing cycle, and/or information about a current phase of the ongoing washing cycle, and/or selected parameters for the ongoing washing cycle, and/or selected drawer compartment, and/or selected treatment agent).

Figure 2A:
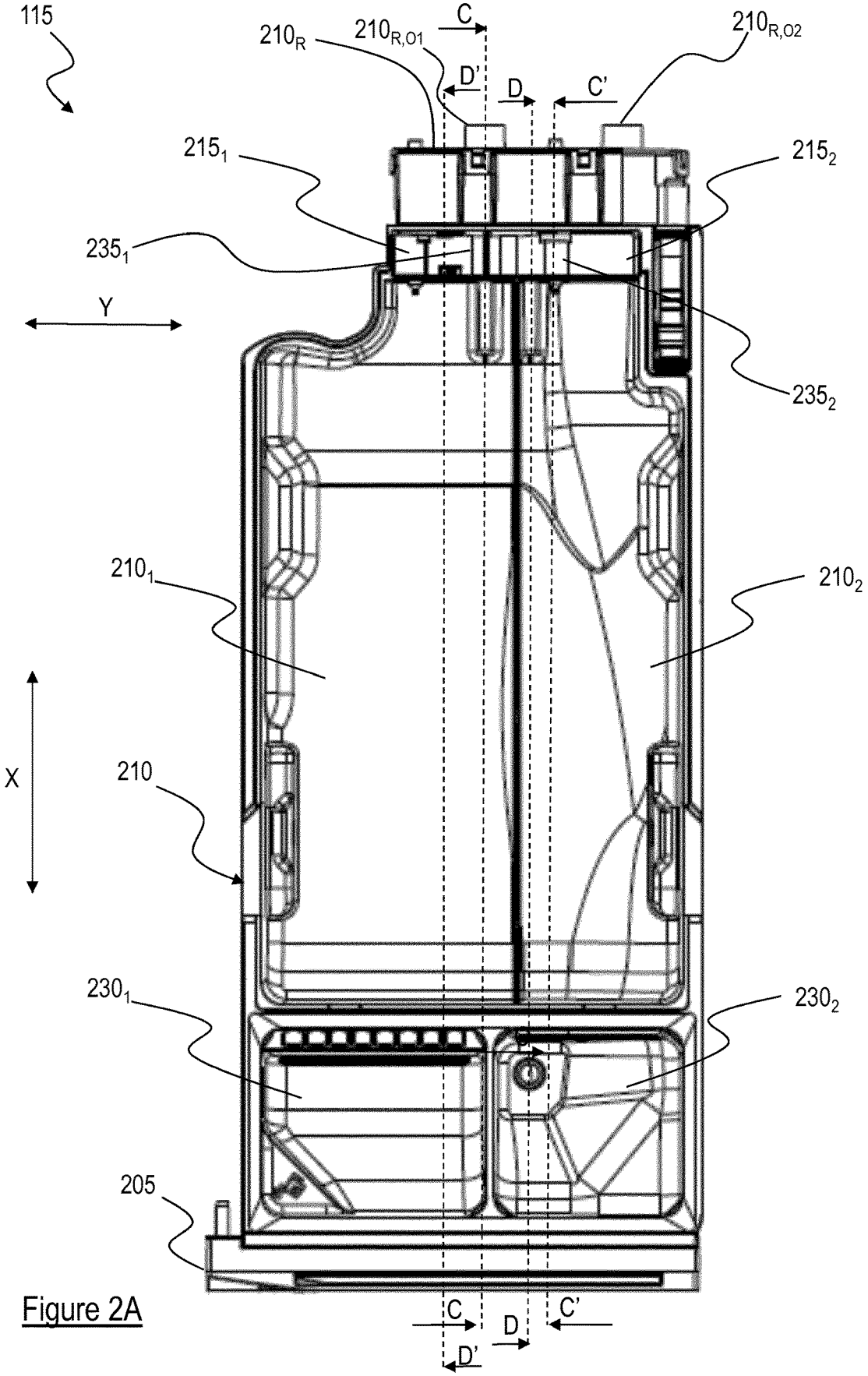
FIG. 2A shows a top view of a drawer of the laundry appliance according to an embodiment of the present invention.

With reference now also to FIG. 2A, it shows top views of the drawer 115 according to an embodiment of the present invention. For ease of description, FIG. 2A will be discussed together with FIG. 2B, which shows a perspective view of the drawer 115 in a partially extracted position within the drawer seat 120, with FIG. 2C, which shows sectional views of the drawer along the C-C axis (right drawing) and C'-C' axis (left drawing) of FIG. 2A, with FIG. 2D, which sectional views of the drawer along the D-D axis (right drawing) and D'-D' axis (left drawing) of FIG. 2A, with FIG. 2E, which shows a sectional view of the drawer in the partially extracted position within the drawer seat along the E-E axis of FIG. 2B, and with FIG. 2F, which shows a perspective and partially exploded view from behind of the drawer 115 and of the drawer seat 120.

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (advantageously, in a removable or reversible way, as better discussed in the following). When the laundry appliance 100 is installed and the drawer 115 is fitted in the drawer seat 120, the drawer handle 205 identifies, along the sliding direction X, a drawer front (which advantageously forms part of the cabinet front when the drawer 115 is in the retracted position).

The drawer 115 preferably comprises, along the sliding direction X (from the drawer front backwards):

behind the handle 205, and hence in the drawer body 210, one or more (two, in the example at issue) drawer compartments $\mathbf{210}_1$,$\mathbf{210}_2$ each one adapted to contain multiple doses of a respective treatment agent for performing multiple washing cycles, hereinafter referred to as multi-dose compartments $\mathbf{210}_1$,$\mathbf{210}_2$. Therefore, the exemplary considered laundry appliance 100 is configured to implement an auto-dosing functionality in which, at each washing cycle (and when the auto-dosing functionality is enabled), a predetermined amount of treatment agent is automatically taken (e.g. by means of a pumping system, discussed in the following) from one or both of the multi-dose compartments $\mathbf{210}_1$,$\mathbf{210}_2$. Just as an example, the multi-dose compartment $\mathbf{210}_1$ may be arranged to contain multiple doses of a liquid washing detergent, whereas the multi-dose compartment $\mathbf{210}_2$ may be arranged to contain multiple doses of a liquid softener;

behind the multi-dose compartments $\mathbf{210}_1$,$\mathbf{210}_2$, and hence in the drawer body 210, one or more (two, in the example at issue) channels $\mathbf{215}_1$,$\mathbf{215}_2$ associated with the multi-dose compartments $\mathbf{210}_1$,$\mathbf{210}_2$ (in the example herein considered, each channel $\mathbf{215}_1$,$\mathbf{215}_2$ is associated with a respective one of the multi-dose compartments $\mathbf{210}_1$,$\mathbf{210}_2$, the channel $\mathbf{215}_1$ being for example associated with the multi-dose compartment $\mathbf{210}_1$ and the channel $\mathbf{215}_2$ being for example associated with the multi-dose compartment $\mathbf{210}_2$). Each channel $\mathbf{215}_1$,$\mathbf{215}_2$ is preferably adapted to channel water and/or one or more treatment agent doses towards a region of the drawer seat 120 that allows a mixture between the water and the treatment agent dose(s) (hereinafter referred to as mixing region): the mixing region may for example be or comprise a bottom wall $\mathbf{220}_{BW}$ of the drawer seat 120 (visible in FIG. 2B), the bottom wall $\mathbf{220}_{BW}$ of the drawer seat 120 being advantageously slanted in order to promote a flow of the mixture between the water and the treatment agent dose(s) towards the treatment chamber of the laundry appliance 100.

Advantageously, the channels $\mathbf{215}_1$,$\mathbf{215}_2$ (or at least one thereof) extend vertically with respect to the rest surface (such as the floor) on which the laundry appliance 100 rests in operation (the channels $\mathbf{215}_1$,$\mathbf{215}_2$ thus extending substantially along the vertical direction Z). In alternative embodiments of the present invention, the channels $\mathbf{215}_1$, $\mathbf{215}_2$ (or at least one thereof) are inclined with respect to the rest surface (such as the floor) on which the laundry appliance 100 rests in operation. Regardless of the specific (vertical or inclined) orientation of the channels $\mathbf{215}_1$,$\mathbf{215}_2$, which is not limiting for the present invention, each channel $\mathbf{215}_1$,$\mathbf{215}_2$ is advantageously structured and shaped such as to allow the water and/or the treatment agent dose(s) to fall towards the mixing region of the drawer seat 120 by gravity; in order to achieve it, each channel $\mathbf{215}_1$,$\mathbf{215}_2$ advantageously comprises a top channel input for receiving the water from a water distribution system above it (as detailed in the following) and a bottom channel output facing the bottom wall $\mathbf{220}_{BW}$ of the drawer seat 120; as will be better detailed in the following, in operation the bottom channel outputs of the channels $\mathbf{215}_1$,$\mathbf{215}_2$ are arranged for delivering the water and the treatment agent dose(s) to the bottom wall $\mathbf{220}_{BW}$ of the drawer seat 120, and hence to the treatment chamber of the laundry appliance 100. Having two separate channels $\mathbf{215}_1$,$\mathbf{215}_2$ each one associated with a respective multi-dose compartment $\mathbf{210}_1$,$\mathbf{210}_2$ is particularly advantageous in the preferred embodiment herein considered in which the multi-dose compartments $\mathbf{210}_1$,$\mathbf{210}_2$ store different types of treatment agents (e.g., liquid washing detergent and liquid softener); in fact, in this way, a mixing between the two different types of treatment agents due to the presence of treatment agent residues from channel walls is avoided;

behind the channels $\mathbf{215}_1$,$\mathbf{215}_2$, and hence in the drawer body 210, one or more (two, in the example at issue) pump actuation parts $\mathbf{225}_1$,$\mathbf{225}_2$ of the pumping system. The pump actuation parts $\mathbf{225}_1$,$\mathbf{225}_2$ preferably have suction sides in fluid communication with the multi-dose compartments $\mathbf{210}_1$,$\mathbf{210}_2$ for drawing up the treatment agent dose(s) therefrom, and delivery sides in fluid communication with the channels $\mathbf{215}_1$,$\mathbf{215}_2$ for delivering the treatment agent dose(s) thereto. Preferably, as herein assumed, the pump actuation part $\mathbf{225}_1$ is associated with the multi-dose compartment $\mathbf{210}_1$ and with the channel $\mathbf{215}_1$ (it meaning that the suction and delivery sides of the pump actuation part $\mathbf{225}_1$ are in fluid communication with the multi-dose compartment $\mathbf{210}_1$ and with the channel $\mathbf{215}_1$, respectively), and the pump actuation part $\mathbf{225}_2$ is associated with the multi-dose compartment $\mathbf{210}_2$ and with the channel $\mathbf{215}_2$ (it meaning that the suction and delivery sides of the pump actuation part $\mathbf{225}_2$ are in fluid communication with the multi-dose compartment $\mathbf{210}_2$ and with the channel $215_2$, respectively). As better discussed in the following, in the retracted position of the drawer 115, the pump actuation parts $225_1$,$225_2$ are adapted to mechanically couple with one or more electrically-operated pump driving parts (preferably provided in the drawer seat 120) of the pumping system, upon said mechanical coupling the electrically-operated pump driving parts allowing driving of the pump actuation parts $225_1$,$225_2$.

According to the preferred embodiment of the present invention herein considered and illustrated, the drawer 115 also comprises one or more (two, in the example at issue) drawer compartments $230_1$,$230_2$ each one adapted to contain a single dose of a respective treatment agent for performing a single washing cycle, hereinafter referred to as mono-dose compartments $230_1$,$230_2$; just as an example, the mono-dose compartment $230_1$ may be arranged to contain a single dose of a powder or liquid washing detergent, whereas the mono-dose compartment $230_2$ may be arranged to contain a single dose of a powder or liquid or pearl softener.

Preferably, the mono-dose compartments $230_1$,$230_2$ are, along the sliding direction X, between the handle 205 and the multi-dose compartments $210_1$,$210_2$. More preferably, the mono-dose compartments $230_1$,$230_2$, which are for example arranged side by side along the transversal direction Y, are formed in a region of the drawer body 210 that, when the drawer handle 205 is mounted on the drawer body 210, is proximal to the drawer handle 205 (hereinafter referred to as front region of the drawer body 210), whereas the multi-dose compartments $220_1$,$220_2$ are formed in a region of the drawer body 210 (hereinafter referred to as rear region of the drawer body 210) that, along the sliding direction X, is rearward with respect to the front region of the drawer body 210.

As visible in the figures, the front and rear regions of the drawer body 210 are properly different in size, and particularly the rear region of the drawer body 210 has a larger area than the front region of the drawer body 210 (as can be best appreciated in FIG. 2A); by way of example only, the area of the rear region of the drawer body 210 is from 2 to 4 times larger than the area of the front region of the drawer body 210. When, as herein exemplary considered, same or substantially same extensions along the vertical direction Z and similar extensions along the transversal direction Y are assumed for the front and rear regions, having the area of the rear region of the drawer body 210 larger than the area of the front region of the drawer body 210 translates into correspondingly different capacities of the mono-dose $230_1$,$230_2$ and multi-dose $210_1$,$210_2$ compartments (with the multi-dose compartments $210_1$,$210_2$ that are sized to store larger amounts of treatment agent as compared to the mono-dose compartments $230_1$,$230_2$).

Forming the multi-dose compartments $210_1$,$210_2$ behind the mono-dose compartments $230_1$,$230_2$ is advantageous in that a low or relatively low extraction of the drawer 115 is required for allowing the user to load the treatment agents in the mono-dose compartments $230_1$,$230_2$ (on the contrary, forming the mono-dose compartments $230_1$,$230_2$ behind the multi-dose compartments $210_1$,$210_2$ would dramatically impair the mechanical stability of the drawer 115, for example when extracting the drawer 115 to load the treatment agents in the mono-dose compartments $230_1$,$230_2$ and a certain amount of treatment agent is still stored in one or more of the multi-dose compartments $210_1$,$210_2$): this is especially true in the exemplary considered embodiment in which the mono-dose compartments $230_1$,$230_2$ are formed side by side along the transversal direction Y, in that a same low extraction of the drawer 115 is required for allowing the user to load treatment agent in any one of the mono-dose compartments $230_1$,$230_2$.

As mentioned above, each pump actuation part $225_1$,$225_2$ has a suction side in fluid communication with the respective multi-dose compartment $210_1$,$210_2$ for drawing up the treatment agent dose therefrom, and a delivery side in fluid communication with the respective channel $215_1$,$215_2$ for delivering the treatment agent dose thereto.

Preferably, the drawer 115 comprises a suction pipe $235_1$,$235_2$ (visible in FIGS. 2A and 2C) coupling the suction side of the pump actuation part $225_1$,$225_2$ to an interior of the multi-dose compartment $210_1$,$210_2$ for drawing up the treatment agent dose therefrom, and a delivery pipe $240_1$, $240_2$ (visible in FIG. 2D) coupling the delivery side of the pump actuation part $225_1$,$225_2$ to an interior of the channel $215_1$,$215_2$ for delivering the treatment agent dose thereto.

The suction pipe $235_1$,$235_2$ is preferably arranged, in the interior of the respective multi-dose compartment $210_1$, $210_2$, proximate to a bottom wall of the multi-dose compartment $210_1$,$210_2$, so as to allow drawing up of treatment agent doses even when the multi-dose compartment $210_1$, $210_2$ is almost empty. In order to make drawing up of treatment agent doses even more effective, the bottom wall of each multi-dose compartment $210_1$,$210_2$ may advantageously be slanted (or at least slightly slanted), in such a way that the treatment agent contained in the multi-dose compartment $210_1$,$210_2$ is allowed to be gathered as much as possible towards the respective suction pipe $235_1$,$235_2$.

The delivery pipe $240_1$,$240_2$ preferably opens to the interior of the respective channel $215_1$,$215_2$, preferably between (for example, in the middle or substantially in the middle of) the top channel input and the bottom channel output thereof.

Each pump actuation part $225_1$,$225_2$ comprises a respective pumping member adapted to push a quantity of the washing agent contained in a respective multi-dose compartment $210_1$,$210_2$ through the respective suction $235_1$, $235_2$ and delivery $240_1$,$240_2$ pipes and, therefore, towards the mixing region of the drawer seat 120.

As mentioned above, the pump actuation part $225_1$,$225_2$ of the pumping system is adapted to mechanically couple, in the retracted position of the drawer 115, with respective one or more electrically-operated pump driving parts (for example, with a respective electrically-operated pump driving part) of the pumping system provided in the drawer seat 120 for allowing driving of the pump actuation part $225_1$, $225_2$.

Each electrically-operated pump driving part may for example comprise an electric motor $245_1$,$245_2$ (the electric motor $245_1$ being visible in FIG. 2E) selectively actuatable (e.g., by means of an electronic control unit and of an electric power supply unit, not shown) for operating the respective pumping member $225_{1,P}$,$225_{2,P}$ (in alternative embodiments of the present invention, a single electric motor may be provided in order to selectively operate both the pumping members $225_{1,P}$,$225_{2,P}$), and an output shaft $245_{1,S}$,$245_{2,S}$ (the output shaft $245_{1,S}$ being visible in FIG. 2E) adapted to be fitted into a corresponding seat of the respective pumping member $225_{1,P}$,$225_{2,P}$. Advantageously, the output shaft $245_{1,S}$,$245_{2,S}$ and the respective seat of the pumping member $225_{1,P}$,$225_{2,P}$ have mutually complementary shapes (the output shaft $245_{1,S}$,$245_{2,S}$ having for example a multi-lobed shape or a star shape), so as to couple or engage with each other when the drawer 115 is moved to the retracted position. More advantageously, each seat is torsionally supported by the respective pumping member $225_{1,P}$,$225_{2,P}$, whereby the coupling between each output shaft $245_{1,S}$,$245_{2,S}$ and the respective seat takes place in a dampened manner and even if their complementary shapes are not perfectly aligned when drawer 115 is pushed to the retracted position.

Preferably, the suction $235_1$,$235_2$ and delivery $240_1$,$240_2$ pipes are in the form of deformable tubes, each pumping member $225_{1,P}$,$225_{2,P}$ preferably comprising a peristaltic rotor (not shown) torsionally supporting, e.g. in a substantially central position thereof, the respective seat, and being adapted to hydraulically cooperate with the respective deformable tube. More preferably, each peristaltic rotor comprises one or more projecting portions (e.g. in the form of rollers, not visible) adapted to be arranged in contact with the walls of the respective deformable tube and capable of locally compressing it, thus generating a consequent narrowing that allows the fluid (i.e., the treatment agent dose(s)) to move during the rotation of the peristaltic rotor.

As visible in the figures, the pumping members $225_{1,P}$, $225_{2,P}$ and the suction $235_1$,$235_2$ and delivery $240_1$,$240_2$ pipes associated therewith are advantageously enclosed, on a rear side of the drawer 115 (rear with respect to the drawer front along the sliding direction X), by a rear wall $210_R$ of the drawer body 210. More preferably, the rear wall $210_R$ comprises openings (two openings $210_{R,O1}$,$210_{R,O2}$ in the example at issue), through which the output shafts $245_{1,S}$, $245_{2,S}$ of the electric motors $245_1$,$245_1$ are able to pass for being coupled with the pumping members $225_{1,P}$,$225_{2,P}$ (particularly, with the seats thereof). Even more preferably, as illustrated, the openings $210_{R,O1}$,$210_{R,O2}$ are delimited by walls (e.g., tubular walls) projecting along the sliding direction X from the rear wall $210_R$ of the drawer body 210; these projecting walls advantageously have centering, aligning and guiding functions for the output shafts $245_{1,S}$,$245_{2,S}$ to be passed into the openings $210_{R,O1}$,$210_{R,O2}$.

Figure 2B:
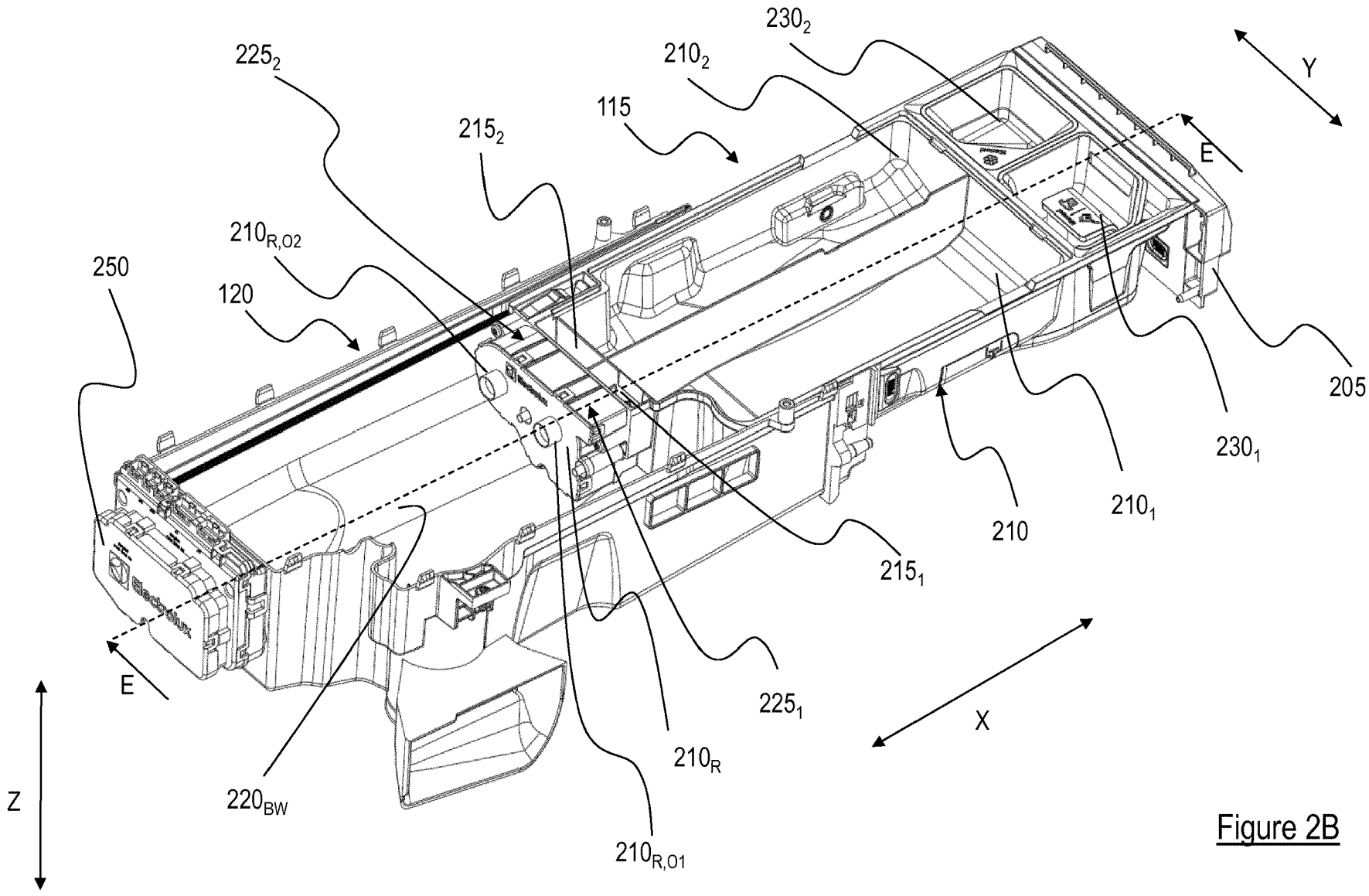
FIG. 2B shows a perspective view of the drawer of FIG. 2A in a partially extracted position within a drawer seat, according to an embodiment of the present invention.
Figure 2C:
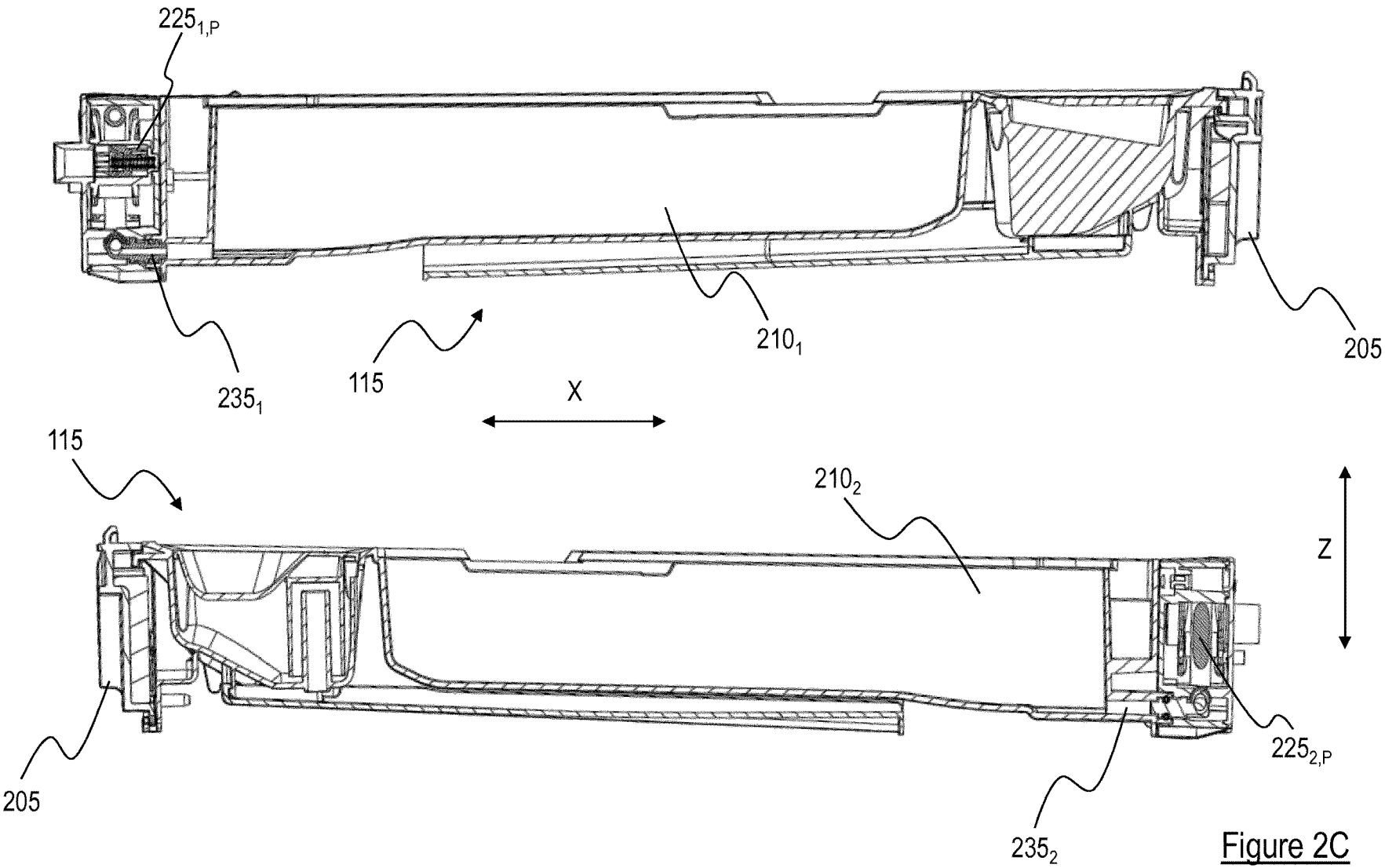
FIG. 2C shows sectional views of the drawer along the C-C and C'-C' axis of FIG. 2A.
Figure 2D:
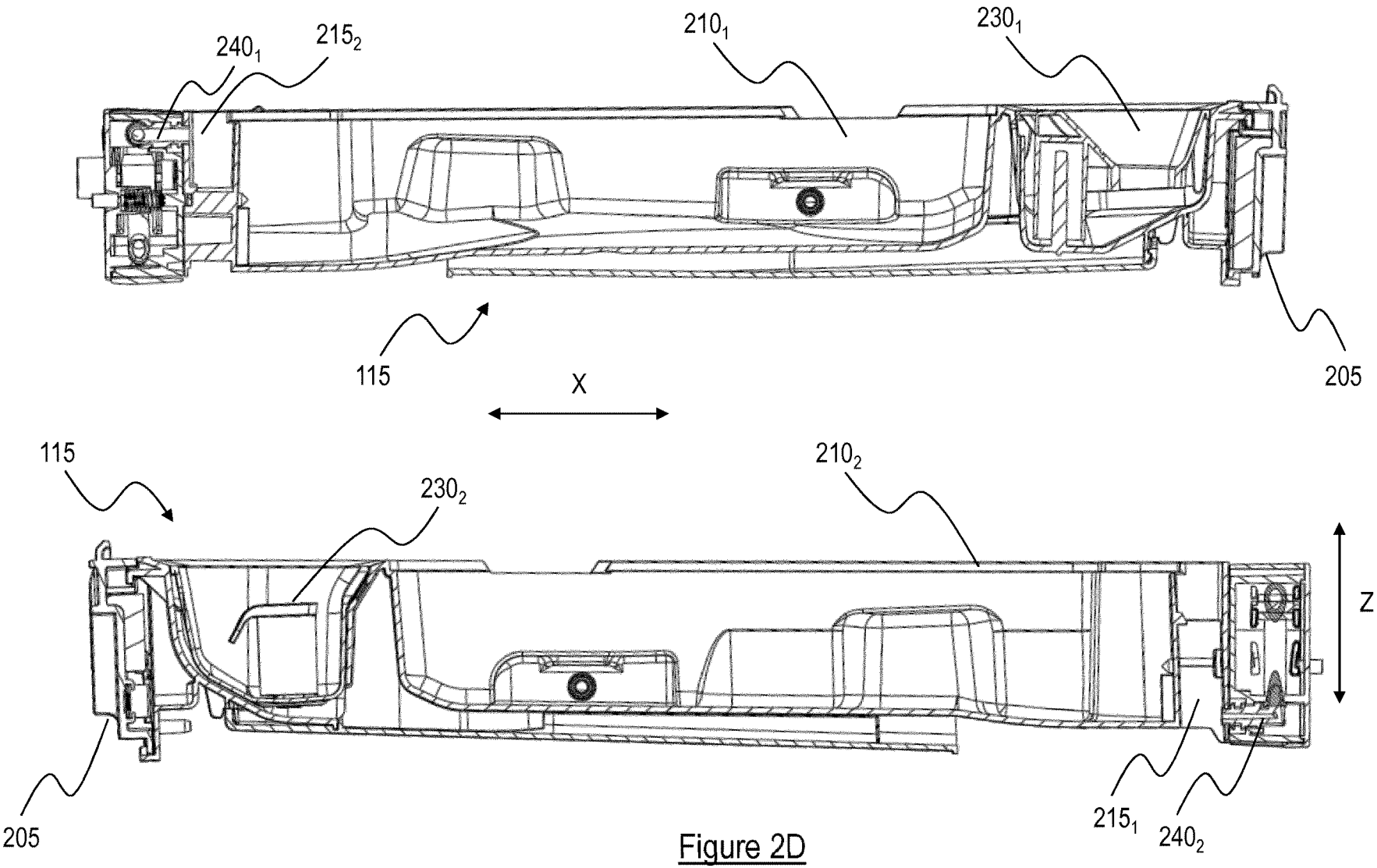
FIG. 2D shows sectional views of the drawer along the D-D and D'-D' axis of FIG. 2A.
Figure 2E:
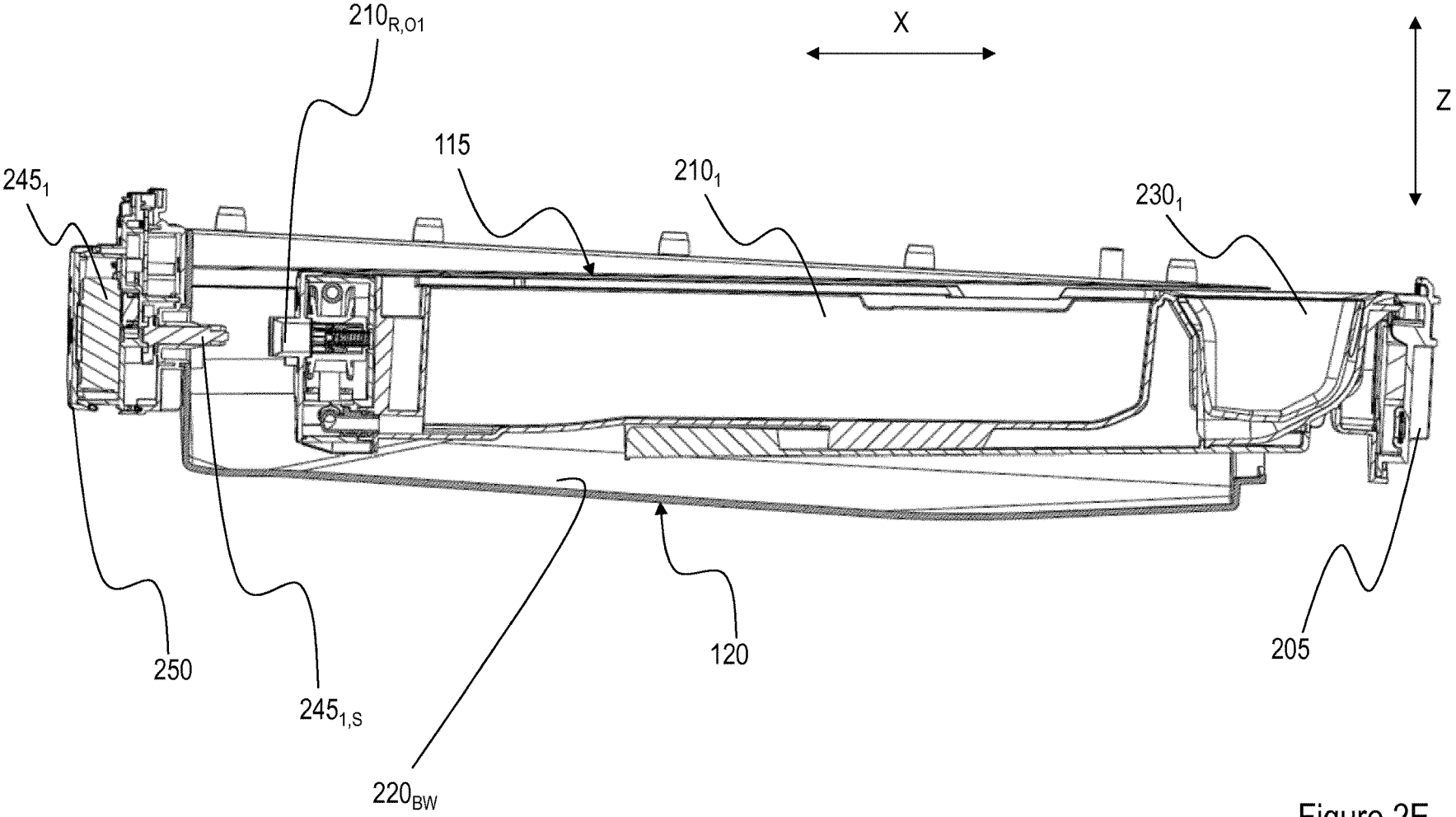
FIG. 2E shows a sectional view of the drawer in the partially extracted position within the drawer seat along the E-E axis of FIG. 2B.
Figure 2F:
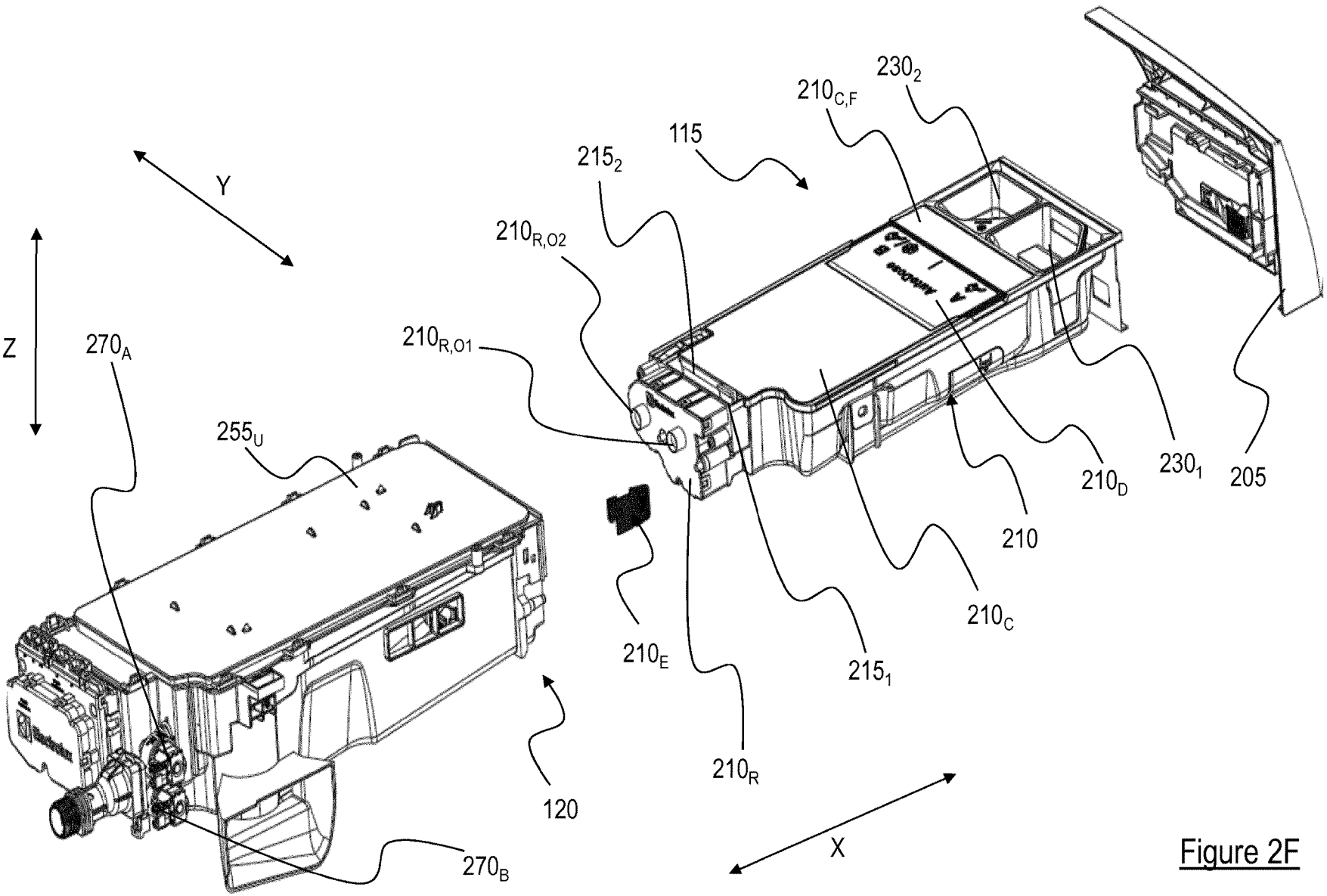
FIG. 2F shows a perspective and partially exploded view from behind of the drawer of FIGS. 2A and 2B and of the drawer seat of FIG. 2B, according to an embodiment of the present invention.

As visible in FIGS. 2B and 2F, the electric motors $245_1$,$245_1$ are advantageously enclosed in a motor shell 250, preferably fixed on the drawer seat 120 (and, hence, separate from drawer body 210) and facing the rear wall $210_R$ of the drawer 115 along the sliding direction X. The motor shell 250 is preferably provided with openings, not shown, through which the output shafts $245_{1,S}$,$245_{2,S}$ of the electric motors $245_1$,$245_1$ project: in this way, when the drawer 115 is moved to the retracted position (i.e., towards the motor shell 250), the output shafts $245_{1,S}$,$245_{2,S}$ of the electric motors $245_1$,$245_1$ engage the pumping members $225_{1,P}$ $225_{2,P}$, thus allowing electrical connection therebetween.

The drawer 115 allows ensuring safe and reliable electrical connections among the electric motors $245_1$,$245_1$, the electronic control unit and the electric power supply unit, in that such electrical connections are substantially unaffected by movement of the drawer 115 from the retracted position to the extracted position; on the contrary, the movement of the drawer 115 between the retracted position and the extracted position only implies a mechanical coupling and decoupling between the pump actuation parts $225_1$,$225_2$, particularly the pumping members $225_{1,P}$,$225_{2,P}$ thereof, and the electrically-operated pump driving parts, particularly the electric motors $245_1$,$245_2$ and the output shafts $245_{1,S}$,$245_{2,S}$ thereof.

Moreover, an electric insulation between the drawer 115 and the electric motors $245_1$,$245_2$ is obtained, since the electric motors $245_1$,$245_2$ (and the respective electrical connections with the electronic control unit and the electric power supply unit) are physically separate from drawer portions (such as the multi-dose compartments $210_1$,$210_2$ and the channels $215_1$,$215_2$) experiencing treatment agent and/or water passage.

Furthermore, the presence of a single, mechanical removable constraint between the electric motors $245_1$,$245_1$ and the pumping members $225_{1,P}$,$225_{2,P}$ allows a simplified and ergonomic operating mode for a user of the laundry appliance 100, in that no periodic control of possible electric disconnections of the electric motors $245_1$,$245_1$ from the electronic control unit and/or the electric power supply unit (e.g., due to drawer 115 movement) is required.

In addition, the drawer 115 may be completely extracted from the drawer seat 120 in a simple manner, for example for cleaning or washing operations to be performed on the drawer 115, without having to worry about preserving the integrity of the electrical connections. FIG. 2F shows the drawer 115 completely extracted from the drawer seat 120: this is advantageously achieved by means of an extraction component (visible in FIG. 2F and globally denoted by the number reference $210_E$) allowing a releasable attachment or connection or coupling or fitting of the drawer 115 to the drawer seat 120. A detailed description of the extraction component $210_E$ (and of embodiments thereof) can be found in EP2876197, which is herein incorporated by reference.

As visible in FIG. 2F, the drawer 115 preferably comprises a drawer body cover $210_C$ for covering the drawer body 210. More preferably, the drawer body cover $210_C$ is configured to cover the rear region of the drawer body 110 in correspondence of the multi-dose compartments $210_1$, $210_2$, thus leaving uncovered both the channels $215_1$,$215_2$, and particularly the top channel inputs thereof (which can therefore be accessed by water fed by a water distribution system, discussed in the following) and the front region of the drawer body 210 (and hence the and mono-dose compartments $230_1$,$230_2$, which can therefore be directly accessed from above for loading the treatment agents therein).

Even more preferably, the drawer body cover $210_C$ comprises one or more access openings, not shown, each one for accessing a respective multi-dose compartment $210_1$,$210_2$ for loading the treatment agent therein; in the example at issue in which the drawer body 210 comprises two multi-dose compartments $210_1$,$210_2$, two access openings are provided in the drawer body cover 210.

The access openings may advantageously be formed in the drawer body cover $210_C$ side by side along the transversal direction Y. More advantageously, the access openings may be formed in proximity of the front region of the drawer body 210 (and, hence, in proximity of the mono-dose compartments $230_1$,$230_2$): therefore, a low or relatively low extraction of the drawer 115 is required for allowing the user to load the treatment agents in the multi-dose-compartments $210_1$,$210_2$ (an excessive extraction of the drawer 115 would instead impair the mechanical stability of the drawer 115, essentially due to its elongated shape and/or to its relatively heavy weight, especially when treatment agents are contained therein). Even more advantageously, as visible in FIG. 2F, the access openings are formed at such a distance (along the longitudinal direction X) from the mono-dose compartments $230_1$,$230_2$ (or from the drawer handle 205, when no mono-dose compartments $230_1$,$230_2$ are provided) that a free region $210_{C,F}$ is defined in the drawer body cover 210: the free region $210_{C,F}$ of the drawer body cover $210_C$ may for example be adapted to contain one or more pieces of information for the user (such as information about correct dosages of the treatment agents according to treatments agents and/or water chemical parameters, and/or general indications or instructions about a correct operation or setting of the auto-dosing functionality).

Preferably, one or more access components may be provided for selectively covering and uncovering the access openings thereby respectively preventing and allowing access to the respective multi-dose compartments $\mathbf{210}_1$,$\mathbf{210}_2$ (in the exemplary considered embodiment, no access components are provided for selectively covering and uncovering the mono-dose compartments $\mathbf{230}_1$,$\mathbf{230}_2$, however this should not be construed as a limitation). As visible in FIG. 2F, the access components comprises a single door $\mathbf{210}_D$, for example a flap door pivotally coupled to the drawer body cover $\mathbf{210}_C$ so as to be actuatable by the user between an open position and a closed position for jointly uncovering and covering, respectively, both the access openings—in any case, in alternative embodiments of the present invention, not shown, two doors may be provided, each door being for example associated with a respective access opening, and hence with a respective multi-dose compartment $\mathbf{210}_1$,$\mathbf{210}_2$.

Figure 2G:
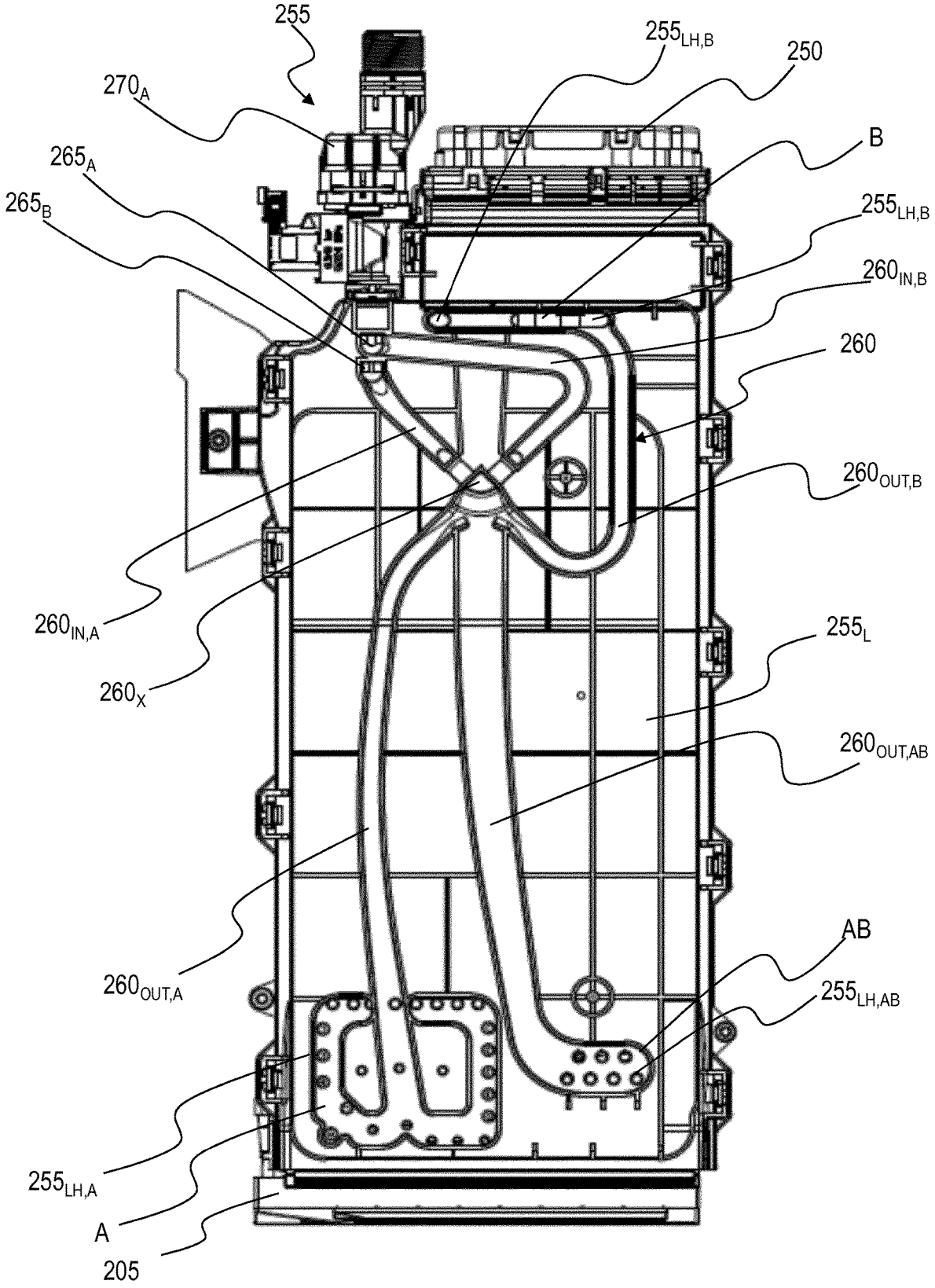
FIG. 2G shows a top view of the drawer seat of FIGS. 2B and 2F, in which a water distribution system is visible, and of the drawer of FIGS. 2A-2F in a retracted position within the drawer seat, according to an embodiment of the present invention.
Figure 2H:
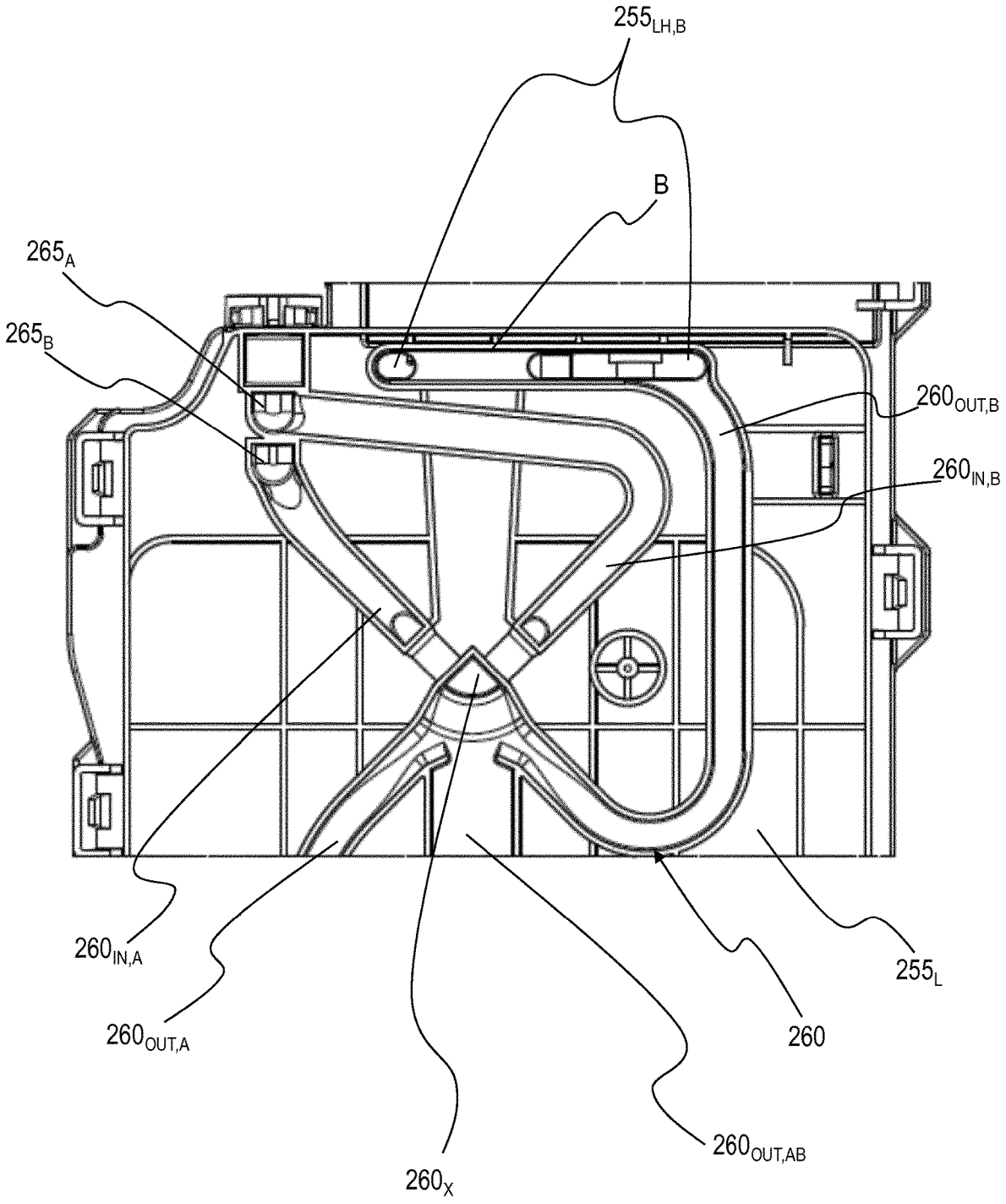
FIG. 2H shows an enlarged view of a portion of the water distribution system of FIG. 2G, according to an embodiment of the present invention.

As mentioned above, the laundry appliance 100 preferably comprises a water distribution system, visible in FIGS. 2G and 2H and denoted as a whole by the number reference 255. Particularly, FIG. 2G shows a top view of the drawer seat 120 (without an upper plate thereof) and of the drawer 115 in the retracted position within it, and FIG. 2H shows an enlarged view of a portion of the water distribution system 255.

The water distribution system 255 preferably comprises a water duct system 260. The water duct system 260 advantageously forms a top of the drawer seat 120, thus allowing the water to be fed to the channels $\mathbf{215}_1$,$\mathbf{215}_2$ (and/or to the mono-dose compartments $\mathbf{230}_1$,$\mathbf{230}_2$, when provided) from above. Particularly, in the preferred embodiment herein considered, the water distribution system 255 comprises a (e.g., plastic) lower plate $\mathbf{255}_L$ (visible in FIGS. 2G and 2H) including the water duct system 260 (the water duct system 260 being for example formed in a single piece with the lower plate $\mathbf{255}_L$, e.g. by injection moulding techniques), and a (e.g., plastic) upper plate $\mathbf{255}_U$ (visible in FIG. 2F) coupled to the lower plate $\mathbf{255}_L$ (e.g., by welding and/or gluing and/or joint) and covering it. Therefore, in use, water flows in the water duct system 260 between the lower $\mathbf{255}_L$ and upper $\mathbf{255}_U$ plates of the water distribution system 255.

As visible in FIGS. 2G and 2H, the water duct system 260 preferably comprises two or more input water ducts each one selectable for water passage therethrough, and one or more output water ducts each one selectable for water passage therethrough according to the input water duct(s) being selected.

As will be better understood from the following discussion, in order to achieve a reduced number of components (and, hence, an architectural simplicity of the laundry appliance 100), the number of input water ducts is conveniently lower than the number of output water ducts: in the example at issue, two input water ducts $\mathbf{260}_{IN,A}$,$\mathbf{260}_{IN,B}$ and three output water ducts $\mathbf{260}_{OUT,A}$,$\mathbf{260}_{OUT,B}$,$\mathbf{260}_{OUT,AB}$ are advantageously provided. More advantageously, the two input water ducts $\mathbf{260}_{IN,A}$,$\mathbf{260}_{IN,B}$ open to an intersection area $\mathbf{260}_X$ of the water duct system 260, from which the three output water ducts $\mathbf{260}_{OUT,A}$,$\mathbf{260}_{OUT,B}$,$\mathbf{260}_{OUT,AB}$ branch in respective directions (namely, two substantially side direction and one substantially central direction).

Preferably, each output water duct $\mathbf{260}_{OUT,A}$,$\mathbf{260}_{OUT,B}$, $\mathbf{260}_{OUT,AB}$ has a respective end A,B,AB placed above a respective region of the drawer 115 when the latter is in the retracted position within the drawer seat 120, and fluidly communicating with a respective underlying region of the drawer 115. More preferably, the lower plate $\mathbf{255}_L$ comprises, in correspondence of the ends A,B,AB of the output water ducts $\mathbf{260}_{OUT,A}$,$\mathbf{260}_{OUT,B}$,$\mathbf{260}_{OUT,AB}$, one or more holes (i.e., through holes) $\mathbf{255}_{LH,A}$,$\mathbf{255}_{LH,B}\mathbf{255}_{LH,AB}$ allowing the passage of water from the output water ducts $\mathbf{260}_{OUT,A}$,$\mathbf{260}_{OUT,B}$,$\mathbf{260}_{OUT,AB}$ to the underlying regions of the drawer 115.

In the exemplary considered embodiment, the ends A,B, AB of the output water ducts $\mathbf{260}_{OUT,A}$,$\mathbf{260}_{OUT,AB}$,$\mathbf{260}_{OUT,B}$ are located above the mono-dose compartment $\mathbf{230}_1$, the mono-dose compartment $\mathbf{230}_2$ and the channels $\mathbf{215}_1$,$\mathbf{215}_2$, respectively. Therefore, the output water duct $\mathbf{260}_{OUT,A}$ is adapted to feed water to the mono-dose compartment $\mathbf{230}_1$, the output water duct $\mathbf{260}_{OUT,AB}$ is adapted to feed water to the mono-dose compartment $\mathbf{230}_2$, and the output water duct $\mathbf{260}_{OUT,B}$ is adapted to feed water to the channels $\mathbf{215}_1$,$\mathbf{215}_2$. In this embodiment, the water duct system 260 comprises a single output water duct (namely, the output water duct $\mathbf{260}_{OUT,B}$) adapted to feed water to the channels $\mathbf{215}_1$,$\mathbf{215}_2$ concurrently (i.e., substantially regardless of the specific multi-dose compartment $\mathbf{210}_1$,$\mathbf{210}_2$ from which the treatment agent dose(s) is/are actually drawn up). This is a particularly advantageous embodiment of the present invention that allows keeping clean the channels $\mathbf{215}_1$,$\mathbf{215}_2$ even when not used: considering for example that a treatment agent dose is taken from the multi-dose compartment $\mathbf{210}_1$, and hence passed to the channel $\mathbf{215}_1$ to be directed towards the mixing region of the drawer seat 120, feeding water also the channel $\mathbf{215}_2$ (in addition to the channel $\mathbf{215}_1$) may contribute to remove residues of treatment agents on the channel walls (and due, for example, to previous washing cycles). However, although a single water feeding duct associated with both channels $\mathbf{215}_1$,$\mathbf{215}_2$ is herein assumed by way of example, embodiments of the present invention may also provide a plurality of (i.e., two or more) water feeding ducts each one associated with a respective channel (for example, a respective one of a plurality of channels).

Advantageously, the water distribution system 255 comprises two inlet connectors $\mathbf{265}_A$,$\mathbf{265}_B$ connectable to a water source (for example, a cold water source), not shown, the water source for example comprising the plumbing of the building in which the laundry appliance 100 is installed. Each inlet connector $\mathbf{265}_A$,$\mathbf{265}_B$ is for example associated with a respective input water duct $\mathbf{260}_{IN,A}$,$\mathbf{260}_{IN,B}$, i.e. each inlet connector $\mathbf{265}_A$,$\mathbf{265}_B$ is connected to the respective input water duct $\mathbf{260}_{IN,A}$,$\mathbf{260}_{IN,B}$ for feeding it with water from the water source. In alternative embodiments of the present invention, not shown, a different number of inlet connectors may be provided, e.g. depending on the number of output water ducts and/or on the number and type of water sources: just as an example, additionally to the inlet connectors $\mathbf{265}_A$,$\mathbf{265}_B$, one or more further inlet connectors, for example connectable to a warm or hot water source (not shown), may be provided.

The inlet connectors $\mathbf{265}_A$,$\mathbf{265}_B$ are advantageously connected to the water source through respective water valves (for example, electromagnetic water valves) $\mathbf{270}_A$,$\mathbf{270}_B$ of the water distribution system 255 (visible in FIGS. 2F and 2H).

The water valves $\mathbf{270}_A$,$\mathbf{270}_B$ are for example controlled by the control unit of the laundry appliance 100, such that when the water valve $\mathbf{270}_A$,$\mathbf{270}_B$ is activated, a water flow is passed through the inlet connector $\mathbf{265}_A$,$\mathbf{265}_B$ into the respective input water duct $\mathbf{260}_{IN,A}$,$\mathbf{260}_{IN,B}$, then into the respective output water duct $\mathbf{260}_{OUT,A}$,$\mathbf{260}_{OUT,B}$, and hence into the underlying drawer region fluidly communicating with it (in the example at issue, the mono-dose compartment $230_1$ and the channels $215_1$,$215_2$, respectively); when instead both water valves $270_A$,$270_B$ are concurrently activated, the crossing of the water flows at the intersection area $260_X$ causes a resultant water flow in the central direction, which is fed into the central output water duct $260_{OUT,AB}$, and hence into the underlying chamber communicating with it (in the example at issue, the mono-dose compartment $230_2$).

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry treatment appliance comprising a drawer adapted to slide within a drawer seat along a sliding direction, the drawer comprising, along the sliding direction from a drawer front:

a handle forming the drawer front;

behind the handle, at least one compartment configured to contain multiple doses of at least one treatment agent;

behind the at least one compartment, at least one channel associated with the at least one compartment and configured to channel water and at least one treatment agent dose of the at least one laundry treatment agent towards a mixing region of the drawer seat to thereby allow mixing between the water and the at least one treatment agent dose;

behind the at least one channel, at least one pump actuation part having a suction side in fluid communication with the at least one compartment and configured to draw up the at least one treatment agent dose therefrom, and a delivery side in fluid communication with the at least one channel and configured to deliver the at least one treatment agent dose thereto; and a water distribution system having at least one water feeding duct configured to feed water to the at least one channel, the at least one water feeding duct being part of a top of the drawer seat thereby allowing the water to be fed to the at least one channel from above.

2. The laundry treatment appliance according to claim 1, wherein the drawer is configured to slide within the drawer seat between an extracted position and a retracted position, and wherein the drawer seat comprises at least one electrically-operated pump driving part that, in the retracted position of the drawer, is configured to mechanically couple with the at least one pump actuation part configured to drive the pump actuation part.

3. The laundry treatment appliance according to claim 1, wherein the at least one channel is configured to allow the water and the at least one treatment agent dose to fall towards the mixing region of the drawer seat by gravity.

4. The laundry treatment appliance according to claim 3, wherein the at least one channel comprises a top channel input configured to receive the water and a bottom channel output, and wherein the drawer is movable to the retracted position in which the bottom channel output of the at least one channel faces said mixing region of the drawer seat for delivering the water and at least one treatment agent dose thereto.

5. The laundry treatment appliance according to claim 1, further comprising at least one suction pipe coupling the suction side of the at least one pump actuation part to an interior of the at least one compartment and configured to draw up the at least one treatment agent dose therefrom, and at least one delivery pipe coupling the delivery side of the at least one pump actuation part to an interior of the at least one channel and configured to deliver the at least one treatment agent dose thereto.

6. The laundry treatment appliance according to claim 1, wherein the at least one water feeding duct comprises a single water feeding duct associated with the at least one channel or a plurality of water feeding ducts each one associated with a respective one of the at least one channel.

7. The laundry treatment appliance according to claim 1, wherein the water distribution system comprises first and second input water ducts each one selectable for water passage therethrough, and first, second and third output water ducts each one selectable for water passage therethrough according to the first and/or second input water ducts being selected, the at least one water feeding duct comprising one or more among the first, second and third output water ducts.

8. The laundry treatment appliance according to claim 1, wherein said at least one compartment comprises two compartments arranged side by side, each one of said two compartments being adapted to contain multiple doses of a respective laundry treatment agent.

9. The laundry treatment appliance according to claim 8, wherein said at least one channel comprises two channels each one associated with a respective one of said two compartments.

10. A drawer for a laundry treatment appliance, the drawer being configured to slide, along a sliding direction, within a drawer seat of the laundry treatment appliance, the drawer comprising, along the sliding direction from a drawer front:

a handle forming the drawer front;

behind the handle, at least one compartment configured to contain multiple doses of at least one treatment agent;

behind the at least one compartment, at least one channel associated with the at least one compartment for channelling water and at least one treatment agent dose of the at least one laundry treatment agent towards a mixing region of the drawer seat allowing a mixture between the water and the at least one treatment agent dose;

behind the at least one channel, at least one pump actuation part having a suction side in fluid communication with the at least one compartment for drawing up the at least one treatment agent dose therefrom, and a delivery side in fluid communication with the at least one channel for delivering the at least one treatment agent dose thereto; and a water distribution system having at least one water feeding duct configured to feed water to the at least one channel, the at least one water feeding duct being part of a top of the drawer seat thereby allowing the water to be fed to the at least one channel from above.

11. The drawer according to claim 10, wherein the drawer is configured to slide within the drawer seat between an extracted position and a retracted position, and in the retracted position of the drawer the at least one pump actuation part of the drawer is configured to mechanically couple with at least one electrically-operated pump driving part provided on the drawer seat and configured to drive the pump actuation part.

12. The drawer according to claim 10, further comprising at least one suction pipe coupling the suction side of the at least one pump actuation part to an interior of the at least one compartment and configured to draw up the at least one treatment agent dose therefrom, and at least one delivery pipe coupling the delivery side of the at least one pump actuation part to an interior of the at least one channel and configured to deliver the at least one treatment agent dose thereto.

13. The drawer according to claim 12 wherein the at least one suction pipe is arranged, in said interior of the at least one compartment, proximate to a bottom wall of the at least one compartment.

* * * * *